US005958181A

United States Patent [19]

Stromberg et al.

[11] Patent Number: 5,958,181

[45] Date of Patent: Sep. 28, 1999

[54] CONTINUOUS COOKING WITH A TWO-STAGE COOL IMPREGNATION

[75] Inventors: C. Bertil Stromberg, Glens Falls, N.Y.; J. Robert Prough, Tarpon Springs, Fla.; Kaj O. Henricson, Helsinki, Finland; Bruno S. Marcoccia, Queensbury, N.Y.

[73] Assignee: Ahlstrom Machinery, Inc., Glens Fall, N.Y.

[21] Appl. No.: 08/911,366

[22] Filed: Aug. 7, 1997

[51] Int. Cl.[6] ..... D21C 3/26

[52] U.S. Cl. ..... 162/19; 162/39; 162/62

[58] Field of Search ..... 162/19, 39, 42, 162/43, 45, 62, 249, 237, 238

[56] References Cited

U.S. PATENT DOCUMENTS

| | | | |
|---|---|---|---|
| 1,922,262 | 8/1933 | Ross, Jr. | 92/7 |
| 1,949,669 | 3/1934 | Wells | 92/7 |
| 2,671,727 | 3/1954 | Westcott et al. | 92/9 |
| 2,789,051 | 4/1957 | Obenshain | 92/11 |
| 4,690,731 | 9/1987 | Hartler et al. | 162/45 |
| 5,489,363 | 2/1996 | Marcoccia et al. | 162/43 |
| 5,547,012 | 8/1996 | Marcoccia et al. | 162/42 |
| 5,674,359 | 10/1997 | Chasse et al. | 162/19 |
| 5,779,856 | 7/1998 | Kettunen | 162/34 |

FOREIGN PATENT DOCUMENTS

| | | |
|---|---|---|
| 1210907 | 9/1986 | Canada . |
| 2 174 874 | 12/1996 | Canada . |
| WO 96 07786 | 3/1996 | WIPO . |

OTHER PUBLICATIONS

Svedman et al, "Relations between Cooking Conditions, Pulp Quality . . . Cooking System", pp. 201–206; admitted prior art.

Rekunen et al, "Examination of Reaction Kinetics in Kraft Cooking", Quaker Chemical, Sep. 17, 1979.

Courchene, "The Tried, The True, and the New—Getting More Pulp from Chips . . . ", TAPPI Symposium "Breaking the Yield Barrier", Feb. 17–18, 1998, pp. 11–20.

Kettunen et al, "Enhanced Alkali Profile Cooking: Further Improvements in Pulp Tear Strength", 1997 Pulping Conference, pp. 587–592.

Kettunen, "Effect of cooking stage EA concentration . . . ", Paperi Ja Puu—Paper and Timber vol. 79/No. 4/1997.

Hultholm et al, "Impregnation in Alkaline Pulping", 1997 Pulping Conference, pp. 897–902.

Marcoccia et al, "Lo–Solids® Pulping: From Theory to Practice", Asian Paper '96, Apr. 24–26, 1996, Singapore.

Gullichsen et al, "On the nonuniformity of the kraft cook part 2", Paperi Ja Puu—Paper and Timber vol. 77 No. 5/1995, pp. 331–337.

Abubasan et al, "The Effects of Alkali Charge and White Liquor Sulfidity . . . ", 1992 Pulping Conference, pp. 1023–1036.

Johansson et al, "Modified continuous kraft pulping—now a reality", Sartryck ur svensk papperstidning nr Oct. 1984 87 (1984) s 30–35.

Sjoblom et al, "Extended Delignification in Kraft Cooking . . . ", Paperi Ja Puu 65 (1983):4, 227–238.

(List continued on next page.)

*Primary Examiner*—Dean T. Nguyen
*Attorney, Agent, or Firm*—Nixon & Vanderhye P.C.

[57] ABSTRACT

A method of treating wood chips allows chemical pulp (e. g. kraft pulp) to be produced having enhanced fiber strength properties. In a first zone or stage the chips are cool impregnated (e. g. a temperature of about 60–120° C.) with a first alkali-containing liquid (25–35 g/l expressed as NaOH). In the top of a continuous digester in a second zone or stage the chips are then treated with a second alkali-containing liquid having an alkali concentration at least 5 g/l less than the first liquid (e. g. 10–20 g/l) and a temperature of between about 120–160° C. (e. g. 130–150° C.). An extraction typically takes place to effect the change in treatment zones. After the second zone the chips are cooked at about 140–180° C. (e. g. 150–170° C.), and higher than in the second zone.

18 Claims, 2 Drawing Sheets

OTHER PUBLICATIONS

Pekkala, "Some features of residual delignification . . . ", No. 4, 1983 Paperi ja Puu—Papper och Tra, pp. 251–263.
Teder et al, "Extended Delignification by Combination . . . ", Specialnummer 41. 1981 Paperi ja Puu—Papper och Tra.
Mjoberg et al, "Extensive Delignification Through Controlled . . . ", Eucepa Symposium, Helsinki, Jun. 2–5, 1980.
Olm et al, "Kinetics of the initial stage of kraft pulping", svensk papperstidning nr 15 1979, pp. 458–464.
Hartler, "Extended delignification in kraft cooking—a new concept", svensk papperstidning nr 15, 1978, pp. 483–484.
Axegard et al, "Framstallning av massa . . . ", svensk papperstidning nr 4, 1978, pp. 97–100.
Norden et al, "Modified Kraft Processes for the Manufacture . . . ", 1978 TAPPI, pp. 181–187.
Aurell et al, "Kraft Pulping of Pine," Svensk Papperstidning arg. 68, Nr 4 –Feb. 28, 1965.
Yllner et al, "A Study of the Removal of the . . . ", Svensk Papperstidning arg. 60, Nr 21 –Nov. 15, 1957.
Bray et al, "The Influence of Chemical Concentration . . . ", Paper Trade Journal, Technical Association Section, TAPPI Section, p. 52, Aug. 3, 1933.
Christiansen et al, "The Relationship between Pulp Quality . . . ", TAPPI, vol. 41, No. 5, May 1958, pp. 216–223.
Schwartz et al, "Chemistry of the Alkaline Wood Pulp Process", Paper Trade Journal, Technical Association Section, TAPPI section, pp. 140–148, Sep. 22, 1938.
Schwartz et al, "Effect of Continuous Liquor Flow in Pulping . . . ", Paper Trade Journal, vol. 123, No. 17, TAPPI Section, pp. 212–218.

CONTINUOUS COOKING WITH A TWO-STAGE COOL IMPREGNATION

BACKGROUND AND SUMMARY OF THE INVENTION

In the chemical pulping of fibrous, cellulosic material for producing paper and board, the raw material is treated with chemicals, for example, sodium and sulfur compounds, at elevated temperature. Typically, this treatment is performed at super-atmospheric pressure to ensure the aqueous solutions remain in liquid form. The chemicals react with the organic and non-organic constituents of the raw material such that some of the organic and non-organic constituents are dissolved to yield a product consisting of cellulose fibers in an aqueous slurry of dissolved reaction products. The slurry is typically cleaned and dewatered to provide an essentially pure form of cellulose fibers for paper making.

Prior to formally cooking the comminuted cellulosic fibrous material at elevated temperature, for example, between 140–180° C., the comminuted cellulosic fibrous material, typically hardwood or softwood chips (though many other types of comminuted cellulosic fibrous material are used), is pretreated (e.g. steamed)to remove entrained air, impregnate the material with cooking liquor, and initiate the heating process, among other things. Though historically this pretreatment raised the temperature of the cellulose material as quickly as feasible or allowed by the feeding equipment, it has now been discovered that the rate of heating need not be rapid, but a more gradual heating or cooler treatment is preferred. Such treatment produces a cellulose pulp having improved fiber properties, for example, increased fiber strength.

Several copending applications disclose methods of effecting this cool pretreatment. For example, U.S. Pat. No. 5,674,359 [the disclosure of which is incorporated by reference herein] discloses a two-step cool impregnation process. In the first step the chips are treated with alkali at a first concentration at a temperature between 80 and 110° C. In a second step, the chips are treated with a second alkali concentration, higher than the first alkali concentration, at a temperature between 110–150° C. The slurry of chips and liquor is then cooked at a temperature of between 150–180° C. Copending application Ser. No. 08/460,723 filed on Jun. 2,1995 [the disclosure of which is incorporated by reference herein] also discloses a method of treating pulp at a cool temperature. This application discloses a process of treating chips by supplying a cool source of alkali during impregnation to neutralize the cellulose-damaging wood acids. In addition, copending application Ser. No. 08/729,022 filed on Oct. 10, 1996 now U.S. Pat. No. 5,736,006, [the disclosure of which is incorporated by reference herein] discloses a method of treating and feeding a slurry of comminuted cellulosic fibrous material to a digester at a relatively cool temperature. This application uses the novel chip bin disclosed in U.S. Pat. Nos. 5,500,083; 5,617,975; and 5,628,873, marketed under the name DIAMONDBACK® by Ahistrom Machinery Inc. of Glens Falls, N.Y., and the novel feeding system disclosed in U.S. Pat. Nos. 5,476,572; 5,622,598; and 5,635,025 (the disclosures of which are hereby incorporated by reference herein), which is marketed under the trademark LO-LEVEL® by Ahistrom Machinery.

However, none of these treatments disclose the most effective means of cool pretreatment and then heating to cooking temperature as disclosed by the present invention.

U.S. Pat. Nos. 5,489,363; 5,536,366; 5,547,012; 5,575,890; and pending application Ser. No. 08/484,315, filed on Jun. 7, 1995 [the disclosure of all of which are incorporated by reference herein] disclose a novel cooking method and equipment which is marketed under the name LO-SOLIDS® by Ahlstrom Machinery. This process includes the control and minimization of dissolved organic material throughout the cooking process in order to improve, among other things, pulp strength, bleachability, and operability of the cooking process.

The present invention combines and supplements the unique features of the processes described above to provide a pretreatment and cooking process that yields improved fiber properties, for example, improved strength, improved distribution of heat and chemical which can result in improved pulp uniformity, and improved operability of the cooking process, while minimizing the use of energy and cooking chemicals. One embodiment of the invention comprises or consists of a method for continuously cooking cellulosic fibrous material, comprising the steps of continuously and sequentially: (a) treating the cellulose fibrous material in a first stage (e.g. zone) with an alkali-containing liquid at a temperature of between about 60–120° C. (preferably 95–105° C., e.g. below 100° C.) and at a first alkali concentration over 10 g/l (e.g. about 20–35, or 25–35, g/1, as NaOH); and (b) treating the cellulose fibrous material in a second stage (zone) with a liquid containing a second alkali concentration at least 5 g./l less (e. g. about 7–15 g/l less) than the first alkali concentration (e.g. between about 10–20 g/l, as NaOH) at a temperature of between about 120–160° C. (e.g. about 130–150° C.) ; and (c) cooking the cellulose material from step b) at a temperature of between about 140–180° C. (e.g. about 150–170° C.) to produce a chemical cellulose pulp (e. g. kraft pulp). The invention may also include an intermediate step (d), between steps (a) and (b), of removing some of the alkali-containing liquid from the material (and preferably at some point replacing it with liquid having a significantly lower dissolved organic material concentration than the removed liquor, e.g. by adding filtrate or water). The treatment step (b) may be performed counter-currently.

The method of the invention also may include other details or modifications. For example, step (b) may practiced using white liquor, and step (a) is practiced using white, green, or black liquor (including mixtures thereof). Step (c) may be practiced at an alkali concentration of between about 18–40 g/l (e. g. 18–25) throughout, and there may be the further step of washing the material after step (c).

Steps (d), (b) and (c) are typically practiced in an upright continuous digester, and step (a) may practiced, but only in part, in an upright continuous digester (the rest of the cool impregnation taking place in the feed system). Of course, more than one vessel may also be used, e.g. an impregnation vessel and a digester.

Step (b) may be practiced by withdrawing liquid from the digester, heating the withdrawn liquid and recirculating the withdrawn liquid back to the digester, adding filtrate or water to the withdrawn liquid prior to heating and recirculation, in sufficient amount to approximately make up for the liquid extracted in step (d), and adding white liquor to the recirculated liquid in an amount sufficient to insure the desired alkali concentration thereof.

The invention also relates to a kraft pulp made by practicing the method described above, and having enhanced fiber properties, including increased fiber strength, compared to kraft pulp made by a process using conventional temperatures and alkali concentrations in the practice of steps (a) and (b).

According to another aspect of the present invention, a method of treating a slurry of comminuted cellulosic fibrous material [using a feed system to an upright continuous digester, the digester having first and second screen assemblies disposed in the digester near the top thereof, the second screen assembly below and spaced from the first screen] is provided. The method comprises the steps of continuously and sequentially: (a) at least partially in the feed system subjecting the comminuted cellulosic fibrous material to cool impregnation with an alkali-containing liquid having a first alkali concentration of at least 10 g/l expressed as NaOH, and at a temperature of between about 60–120° C. (e.g. 80–110°), and feeding the cool impregnated-material to the top of the digester; (b) extracting some of the alkali-containing liquid from the material using the first screen assembly; (c) between the first and second screen assemblies, treating the material with a second liquid having a second alkali concentration at least 5 g/l less than the first concentration, and at a temperature of 120–160° C.; and (d) below the second screen assembly cooking the material at a temperature of between about 140–180° C. The details of the temperatures and alkali concentrations preferably are as set forth above with respect to the first aspect of the invention.

The method also typically comprises the further step (e) of withdrawing some liquid from the slurry using a third screen assembly, above the first screen assembly, and recirculating the liquid withdrawn in step (e) to the feed system. The feed system used typically includes a chip bin connected to a chip tube, in turn connected to a helical screw pump, in turn directly connected to a high pressure feeder for feeding the slurry to the top of the digester. Also, step (c) is typically practiced in part by the substeps of (1) withdrawing liquid from the slurry using the second screen assembly, (2) recirculating at least the majority of the withdrawn liquid to the interior of the digester at about the level of the second screen assembly, (3) adding cooking liquor and make up liquor to the recirculated liquid to produce an augmented liquor, and (4) heating the augmented liquid, substeps (1)–(4) being practiced so that the liquid recirculated to the digester has a temperature of between about 140–160° C., and an alkali concentration of between about 10–20 g/l expressed as NaOH. Substep (3) is preferably practiced by adding filtrate or water as make-up liquid, and white liquor as cooking liquor.

It is the primary object of the present invention to provide a method of producing chemical pulp with optimum fiber properties from wood chips or the like by using cool impregnation and desirable alkali concentrations and temperatures at significant times during treatment of the chips. This and other objects of the invention will become clear from an inspection of the detailed description of the drawings, and from the appended claims.

DETAILED DESCRIPTION OF THE DRAWINGS

Figure 1:
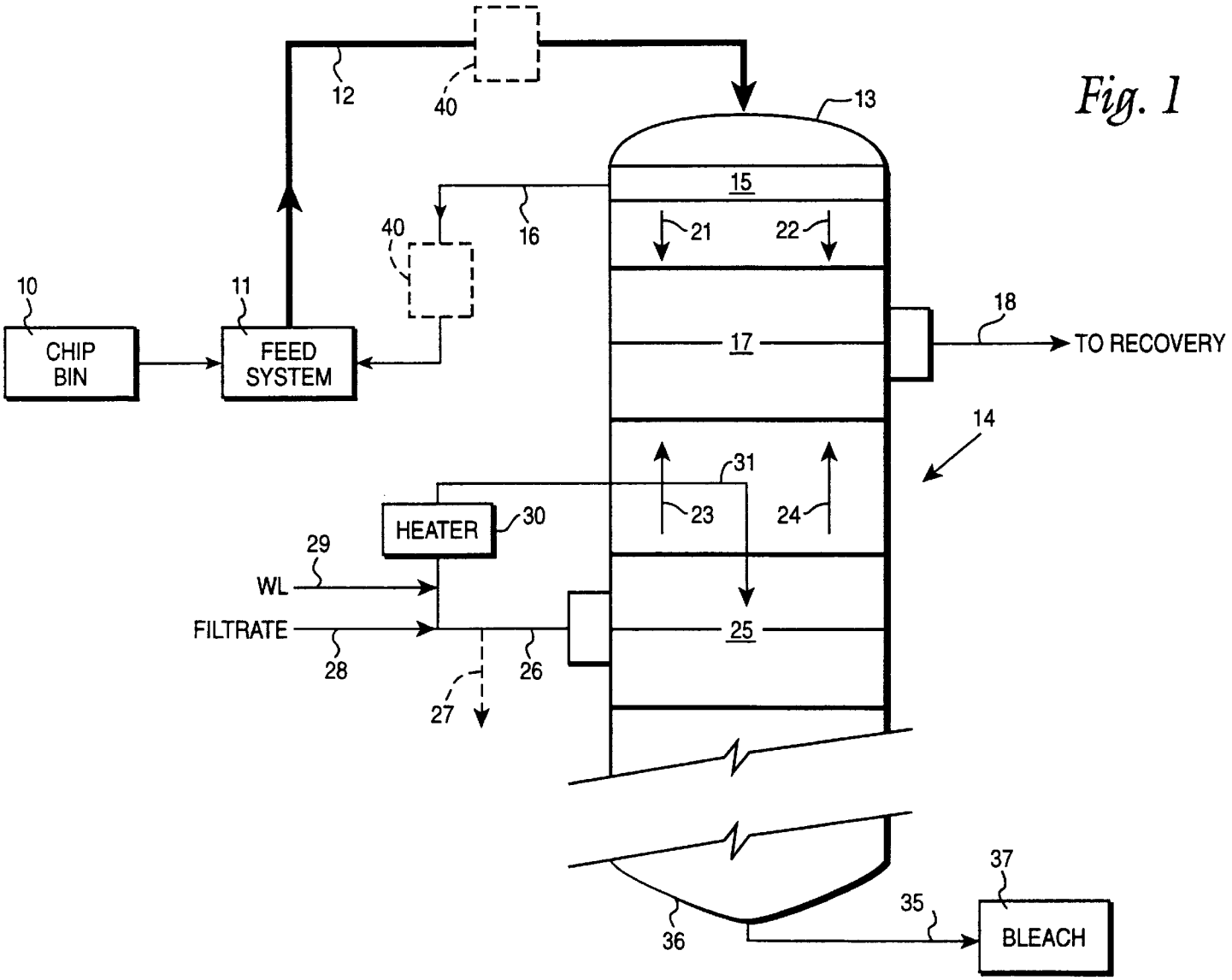
FIG. 1 is a schematic representation of a system, including the top of a continuous digester, with which the method of the present invention may be practiced.

An exemplary system for practicing the method of the invention is illustrated schematically in FIG. 1. As seen in FIG. 1, hardwood or softwood chips, or other comminuted cellulosic fibrous material, is steamed in the chip bin 10 (preferably a DIAMONDBACK® chip bin, having one-dimensional convergence and side relief), and then slurried with liquid and fed by the feed system 11, through line 12, to the top 13 of the upright continuous digester 14. The system 11 is preferably a LO-LEVEL® feed system, which is shown in detail in FIG. 2 and will be described in detail with respect to that figure. In the system 11 the material is subjected to cool impregnation, with a first alkali-containing liquid having a first alkali concentration, greater than 10 g/l expressed as NaOH [all alkali concentrations herein are expressed as NaOH], and preferably between about 20–35 g/l (e. g. 25–35 g/l), and at a temperature of between about 60–120° C. (e.g. 80–110° C., or 95–105° C., and desirably less than 100° C.). The material becomes impregnated with the alkali-containing liquor (usually white liquor, black liquor, green liquor, or mixtures thereof) in the system 11, and at the top 13 of the digester 14.

The slurry moves downwardly in vessel 14, first encountering a conventional bottom circulation screen assembly 15. Screen assembly 15 removes some of the liquor of the material slurry and recirculates it to the feed system 11, in line 16. The slurry flows downwardly, both chips (arrow 21), and liquid (arrow 22) to the screen assembly 17.

The screen assembly 17 (hereafter "screen" for convenience) is desirably used to extract some of the liquid from the slurry since the alkali content of the liquid needs to be changed between the top 13 of the digester 14 and the cooking zone. The screen 17 provides an extraction screen which removes liquid in line 18 (e. g. passing it to heat exchange in flash tanks, and to recovery). For example, the post-impregnation extraction of liquor in line 18 is at a temperature between about 80–120° C., and with about 3–5 g/l of alkali.

Starting at about the vicinity of the screen 17, the alkali concentration of the liquid of the slurry changes. In a stage or zone at and below the screen assembly 17 (between the screen assemblies 17, 25) the material is subjected to a second alkali-containing liquid, having a second alkali concentration which is at least 5 g/l less than the first liquid (entering the top 13 of the digester 14 with the material), for example about 7–15 g/l less. The second liquid typically has an alkali concentration of between about 10–20 g/l, and a temperature of between about 120–160° C. (e. g. 130–150° C.); that is the temperature of the material in the zone or stage between the screens 17, 25 is about 120–160° C. (e.g. 130–150° C.).

In the zone between screens 17, 25 there typically is countercurrent treatment (which will naturally occur if screen 17 is an extraction screen, as illustrated in FIG. 1). The counter-current treatment is indicated by the opposite direction of the flow arrows 23 (material) and 24 (liquid).

The desired conditions are reached in the zone between screens 17, 25 by withdrawing liquid from the digester 14 using screen 25, into recirculation line 26. If desired to reduce dissolved organic material ("DOM") concentration of the liquor, a partial extraction may be provided here, as indicated in dotted line at 27 in FIG. 1. Make-up liquor (low DOM, and in an approximate volume to make up for that extracted in line 18) is preferably added at 28. The make-up liquid preferably is a filtrate, or water. Alkali-containing liquor—typically white liquor—is added too, as indicated at 29, in sufficient quantity, and with an appropriate concentration, to ensure the desired alkali concentration of the second liquid (e. g. 10–20 g/l). The augmented and recirculated liquid in line 26 downstream of introductions 28, 29 is heated in conventional indirect heater 30, and recirculated in line 31 to the interior of the digester 14, at the approximate level of withdrawal.

After passing the screen 25 (i. e. below screen 25), the slurried material passes into a cooking zone or stage 32, in which the temperature is between about 140–180° C. (e. g. 150–170° C.), and typically at least about 5° C. above the temperature in the second zone (between screens 17, 25). During cooking, in one or more co-current or counter-current zones (with or without removal of high DOM liquor and replacement with lower DOM liquor), the alkali concentration is provided at any suitable level for the material involved, but typically is between about 15–40 g/l (e.g. 18–25)

The digester 14 also typically includes a conventional wash zone below the cooking zone(e) 32, and ultimately the pulp (e. g. kraft pulp)—having enhanced fiber properties (e. g. strength) compared to a pulp produced via conventional kraft temperature and alkali conditions were used in the feed system 11 through the screen 25—is discharged in line 35 in the bottom 36 of the digester 14, as is conventional per se. The pulp is typically further washed (not shown) and then bleached, as indicated schematically at 37 in FIG. 1.

Figure 2:
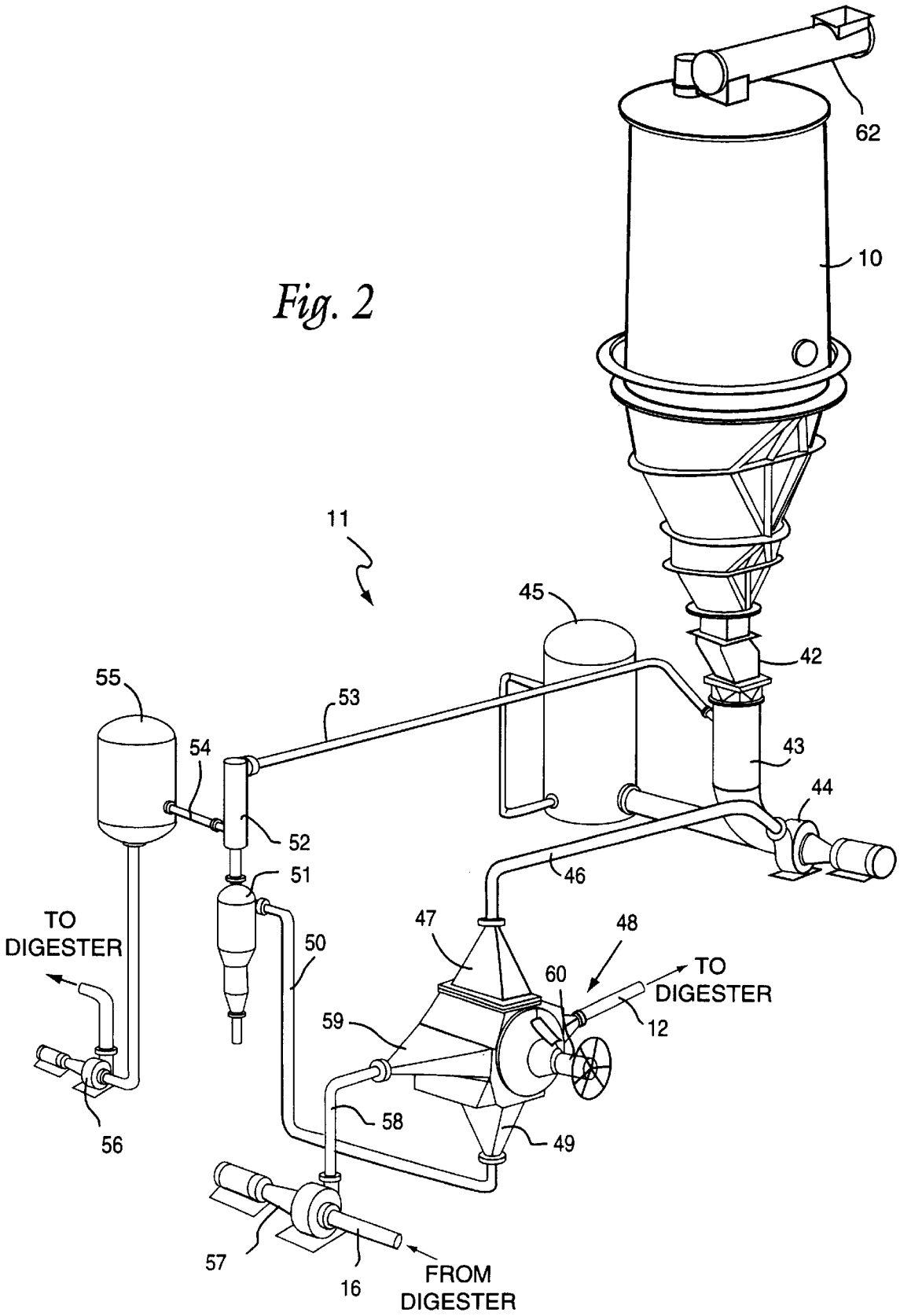
FIG. 2 is a schematic representation of the feed system that may be used with the digester of FIG. 1 in the practice of the method according to the invention.

The feed system 11, which allows the cool impregnation of the invention to be practiced, as well as having numerous other advantages over conventional feed systems, is illustrated in more detail in FIG. 2, and preferably comprises a LO-LEVEL® feed system. If cooling of any of the liquids is necessary to maintain the desired impregnation temperature, conventional indirect heat exchangers (coolers), illustrated only schematically at 40 in FIG. 1, may be used.

The feed system 11 of FIG. 2 preferably includes a chip meter 42 or other metering device (such as a metering screw) connected to a chip tube 43, connected at the bottom thereof to the inlet to a helical screw chip pump 44. Pump 44 and tube 43 are also connected to liquor surge tank 45. The discharge from the pump 44 is connected via line 46 to the low pressure inlet 47 to the conventional high-pressure transfer device 48 (preferably a high pressure feeder, sold by Ahistrom Machinery). The low pressure outlet 49 passes primarily liquid through line 50 to sand separator 51, the liquid then passing to in-line drainer 52. Line 53 from the top of the drainer 52 leads to the chip tube 43, for slurrying the material, while separated liquor in line 54 from the bottom leads to the level tank 55. Pump 56 pumps liquid from the level tank 55 to be used in the digester 14, if needed.

The high pressure side of the feeder 48 includes the centrifugal pump 57 connected by line 58 to the high pressure inlet 59 of the feeder 48. The high pressure outlet 60 from feeder 48 is connected to line 12 leading to the top of the digester. The temperature in the system 11 is maintained between about 60–120° C. (e. g. 95–105° C.).

The chip bin 10 illustrated in FIG. 2 is a DIAMOND-BACK® chip bin, with one-dimensional convergence and side relief. It is typically supplied with material by air lock 62, for example a screw conveyor with a weighted gate as described in co-pending application Ser. No. 08/713,431, filed on Sep. 13, 1996.

While it is desirable to use the apparatus illustrated in FIGS. 1 and 2 in the practice of the method of the invention, an impregnation vessel (part of a two vessel digester system, rather than the one vessel, hydraulic, digester 14), or other conventional equipment, also may be used.

It will thus be seen that according to the present invention an advantageous method has been provided for producing chemical pulp, particularly kraft pulp, with enhanced fiber properties. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of cooking comminuted cellulosic fibrous material, comprising the steps of continuously, sequentially:

(a) in a first stage, treating a slurry of the comminuted cellulosic fibrous material with a first alkali-containing liquid at a temperature between about 60–120° C., and at a first alkali concentration that is over 10 g/l expressed as NaOH;

(b) in a second stage, treating the slurry comminuted cellulosic fibrous material with a second alkali-containing liquid at a second alkali concentration that is at least 5 g/l, expressed as NaOH, less than the first concentration, and at a temperature of between about 120–160° C.; and (c) cooking the slurry of comminuted cellulosic fibrous material from step (b) at a temperature of between about 140–180° C. to produce a chemical pulp.

2. A method as recited in claim 1 wherein step (a) is practiced at a temperature of between 95–105° C., step (b) at a temperature between 130–150° C., and step (c) at a temperature between about 150–170° C., and the temperature in step (c) is at least 5° C. higher than the temperature in step (b).

3. A method as recited in claim 1 wherein steps (b) is practiced using white liquor, and step (a) is practiced using white, green, or black liquor.

4. A method as recited in claim 1 wherein step (c) is practiced at an alkali concentration of between about 18–40 g/l throughout.

5. A method as recited in claim 1 comprising the further step of washing the material after step (c), and wherein step (b) is practiced counter-currently.

6. A method as recited in claim I wherein step (a) is practiced so that the first concentration is between about 25–35 g/l as NaOH, and step (b) is practiced so that the second concentration is between about 10–20 g/l expressed as NaOH, and wherein the second concentration is about 715 g/l, expressed as NaOH, less than the first concentration.

7. A method as recited in claim 6 comprising the further step (d), between steps (a) and (b), of extracting some of the first alkali-containing liquid from the material.

8. A method as recited in claim 7 wherein steps (d), (b) and (c) are practiced in an upright continuous digester.

9. A method as recited in claim 8 wherein step (a) is practiced, but only in part, in the upright continuous digester.

10. A method as recited in claim 8 wherein step (b) is practiced by withdrawing liquid from the digester, heating the withdrawn liquid and recirculating the withdrawn liquid back to the digester, adding filtrate or water to the withdrawn liquid prior to heating and recirculation, in sufficient amount to approximately make up for the liquid extracted in step (d), and adding white liquor to the recirculated liquid in an amount sufficient to insure the desired alkali concentration thereof.

11. A method of treating a slurry of comminuted cellulosic fibrous material using a feed system to an upright continuous digester, the digester having first and second screen assemblies disposed in the digester near the top thereof, the second screen assembly below and spaced from the first screen assembly, said method comprising the steps of continuously and sequentially:

(a) at least partially in the feed system, subjecting the comminuted cellulosic fibrous material to cool impregnation with an alkali-containing liquid having a first alkali concentration of at least 10 g/l expressed as NaOH, and at a temperature of between about 60–120° C., and feeding the cool impregnated material to the top of the digester;

(b) extracting some of the alkali-containing liquid from the material using the first screen assembly;

(c) between the first and second screen assemblies, treating the material with a second liquid having a second alkali concentration at least 5 g/l less than the first concentration, and at a temperature of 120–160° C.; and (d) below the second screen assembly cooking the material at a temperature of between about 140–180° C.

12. A method as recited in claim 11 wherein step (b) is practiced to extract liquid at a temperature of about 80–120° C., and with an alkali concentration of about 3–5 g/l.

13. A method as recited in claim 11 wherein step (a) is practiced at a temperature of between 80–110° C., step (c) at a temperature between 130–150° C., and step (d) at a temperature between about 150–170° C., and the temperature in step (d) is at least 5° C. higher than the temperature in step (c).

14. A method as recited in claim 11 comprising the further step (e) of withdrawing some liquid from the slurry using a third screen assembly, above the first screen assembly, and recirculating the liquid withdrawn in step (e) to the feed system.

15. A method as recited in claim 14 wherein step (a) is practiced so that the first alkali concentration is between about 20–35 g/l expressed as NaOH and step (c) is practiced so that the second alkali concentration is between about 10–20 g/l expressed as NaOH.

16. A method as recited in claim 11 wherein step (c) is practiced in part by the substeps of (1) withdrawing liquid from the slurry using the second screen assembly, (2) recirculating at least the majority of the withdrawn liquid to the interior of the digester at about the level of the second screen assembly, (3) adding cooking liquor and make up liquor to the recirculated liquid to produce an augmented liquor, and (4) heating the augmented liquid, substeps (1)–(4) being practiced so that the liquid recirculated to the digester has a temperature of between about 140–160° C., and an alkali concentration of between about 10–20 g/l expressed as NaOH.

17. A method as recited in claim 16 wherein step (a) is practiced using as the feed system a chip bin connected to a chip tube, in turn connected to a helical screw pump, and in turn connected to a high pressure feeder.

18. A method as recited in claim 16 wherein substep (3) is practiced by adding filtrate or water as make-up liquid, and white liquor as cooking liquor.

* * * * *